US007064533B2

(12) United States Patent
Hsu

(10) Patent No.: US 7,064,533 B2
(45) Date of Patent: Jun. 20, 2006

(54) EFFICIENCY IMPROVED VOLTAGE CONVERTER

(75) Inventor: Chih-Yuan Hsu, Tainan (TW)

(73) Assignee: Richtek Technology Corp., Hsinchu (TW)

( * ) Notice: Subject to any disclaimer, the term of this patent is extended or adjusted under 35 U.S.C. 154(b) by 100 days.

(21) Appl. No.: 10/883,750

(22) Filed: Jul. 6, 2004

(65) Prior Publication Data

US 2005/0017701 A1 Jan. 27, 2005

(30) Foreign Application Priority Data

Jul. 21, 2003 (TW) ..... 92213312 U

(51) Int. Cl.
*G05F 1/40* (2006.01)

(52) U.S. Cl. ..... 323/282

(58) Field of Classification Search ..... 323/282, 323/284; 307/31, 34

See application file for complete search history.

(56) References Cited

U.S. PATENT DOCUMENTS 5,442,534 A * 8/1995 Cuk et al. ..... 363/16
2005/0213354 A1* 9/2005 Pai ..... 363/21.06

* cited by examiner

*Primary Examiner*—Adolf Berhane
(74) *Attorney, Agent, or Firm*—Rosenberg, Klein & Lee

(57) ABSTRACT

A voltage converter improves the efficiency thereof by connecting a boost converter and an LDO regulator with a buck converter in parallel. The boost converter boosts up a supply voltage to generate a first output voltage at a first output, and the buck converter bucks down the supply voltage to generate a second output voltage at a second output. When the second output voltage is lower than a threshold, the LDO regulator converts the first output voltage to a third voltage at said second output.

3 Claims, 6 Drawing Sheets

EFFICIENCY IMPROVED VOLTAGE CONVERTER

FIELD OF THE INVENTION

The present invention relates generally to a voltage converter and more particularly, to the efficiency improvement of a voltage converter.

BACKGROUND OF THE INVENTION

Battery is widely used for the power source in portable electronic products. However, the battery voltage will be gradually decayed with its operational time or suddenly dropped down resulted from instant increasing of load current flowing through the internal resistor of the battery. For a battery voltage will be out of a desired range, it is generally employed buck-boost converter or two-stage, i.e., boost-then-buck, voltage converter in order to maintain a stable output voltage for power supply to a load.

FIG. 1 shows a conventional two-stage voltage converter 10 that includes a boost converter 12 connected in series with a buck converter 14. The boost converter 12 is connected between a supply voltage $V_S$ provided by one or more batteries and an output 1202 to boost up the supply voltage $V_S$ to generate an output voltage $V_{OUT1}$ to supply for a load 162 connected to the output 1202, and the buck converter 14 is connected between the output 1202 and 1402 to convert the boosted voltage $V_{OUT1}$ to another output voltage $V_{OUT2}$ to supply for another load 164 connected to the output 1402. For typical applications, the supply voltage $V_S$ is in the range of from 1.8V to 3.3V, the boosted voltage $V_{OUT1}$ is about 3.3V, and the bucked voltage $V_{OUT2}$ is about 1.8V. The boost converter 12 comprises an inductor $L_1$ connected between the supply voltage $V_S$ and a node 1204, a diode $D_1$ connected between the node 1204 and the output 1202, a transistor $Q_1$ connected between the node 1204 and ground, a capacitor $C_1$ connected between the output 1202 and ground, and a boost controller 122 to switch the transistor $Q_1$ for regulating the output voltage $V_{OUT1}$. On the other hand, the buck converter 14 comprises an inductor $L_2$ connected between the output 1402 and a node 1404, a diode $D_2$ connected between the node 1404 and ground, a capacitor $C_2$ connected between the output 1402 and ground, a transistor $Q_2$ connected between the output 1202 and the node 1404, and a buck controller 142 to switch the transistor $Q_2$ for regulating the output voltage $V_{OUT2}$. However, for the two-stage voltage converter 10 boosting up the supply voltage $V_S$ first and then bucking down the boosted voltage $V_{OUT1}$, the total efficiency to convert the supply voltage $V_s$ to the output voltage $V_{OUT2}$ will be the efficiency product of the boost converter 12 and the buck converter 14, i.e., $\eta_{Boost} \times \eta_{Buck}$, and therefore, the total efficiency of the two-stage voltage converter 10 is decreased by such two-stage conversion.

FIG. 2 shows a conventional SEPIC converter 20 that comprises a boost converter 22 and a buck-boost converter 24 both connected to a supply voltage $V_S$. As usual, the boost converter 22 is connected between the supply voltage $V_S$ and a load 262 connected to its output 2204, to boost up the supply voltage $V_S$ to generate an output voltage $V_{OUT1}$, at the output 2204. The buck-boost converter 24 is connected between the supply voltage $V_S$ and another load 264 connected to its output 2406, to convert the supply voltage $V_S$ to another output voltage $V_{OUT2}$ at the output 2406. The boost converter 22 comprises an inductor $L_1$ connected between the supply voltage $V_S$ and a node 2202, a diode $D_1$ connected between the node 2202 and the output 2204, a capacitor $C_1$ connected between the output 2204 and ground, a transistor $Q_1$ connected between the node 2202 and ground, and a boost controller 222 to switch the transistor $Q_1$ for regulating the output voltage $V_{OUT1}$. On the other hand, the buck-boost converter 24 comprises an inductor $L_2$ connected between the supply voltage $V_S$ and a node 2402, another inductor $L_3$ connected between a node 2404 and ground, a diode $D_2$ connected between the node 2404 and the output 2406, a capacitor $C_2$ connected between the output 2406 and ground, another capacitor $C_3$ connected between the nodes 2402 and 2404, a transistor $Q_2$ connected between the node 2402 and ground, and a buck controller 242 to switch the transistor $Q_2$ for regulating the output voltage $V_{OUT2}$. However, a buck-boost converter does not have high conversion efficiency, and the two energy-storing elements, inductors $L_2$ and $L_3$, bring the buck-boost converter 24 to high cost and large size.

Moreover, as shown in FIG. 1 and FIG. 2, other transient loadings 160 and 260, such as photoflash and motor, also connected to the supply voltage $V_S$ would generate surge current It that causes the supply voltage $V_S$ suddenly dropped down because of the surge current It flowing through the internal resistor of the battery, and thereby the supply voltage $V_S$ may be lower than the output voltage $V_{OUT2}$, as shown by curve 406 in FIG. 4, to further degrade the efficiency thereof.

Although both the voltage converters 10 and 20 shown in FIG. 1 and FIG. 2 may maintain the output voltage $V_{OUT2}$ stably at desired level, their conversion efficiencies are only around 80%, as shown in FIG. 5 by curve 52 for the two-stage voltage converter 10 and by curve 54 for the SEPIC converter 20.

Therefore, it is desired an efficiency improved voltage converter.

SUMMARY OF THE INVENTION

One object of the present invention is to provide a voltage converter in which the efficiency is improved by a combination of linear mode and switch mode converters. In a voltage converter, according to the present invention, a boost converter is connected between a supply voltage provided by one or more batteries and a first output, a buck converter is connected between the supply voltage and a second output, and a low dropout (LDO) regulator is connected between the first output and the second output. The boost converter boosts up the supply voltage to generate a first output voltage at the first output, and the buck converter bucks down the supply voltage to generate a second output voltage at the second output. When the supply voltage is lower than a threshold, the LDO regulator converts the first output voltage to a third voltage at the second output. A shutdown circuit is further included in the buck converter to turn off the buck converter to prevent reverse current to flow toward to the battery.

BRIEF DESCRIPTION OF DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
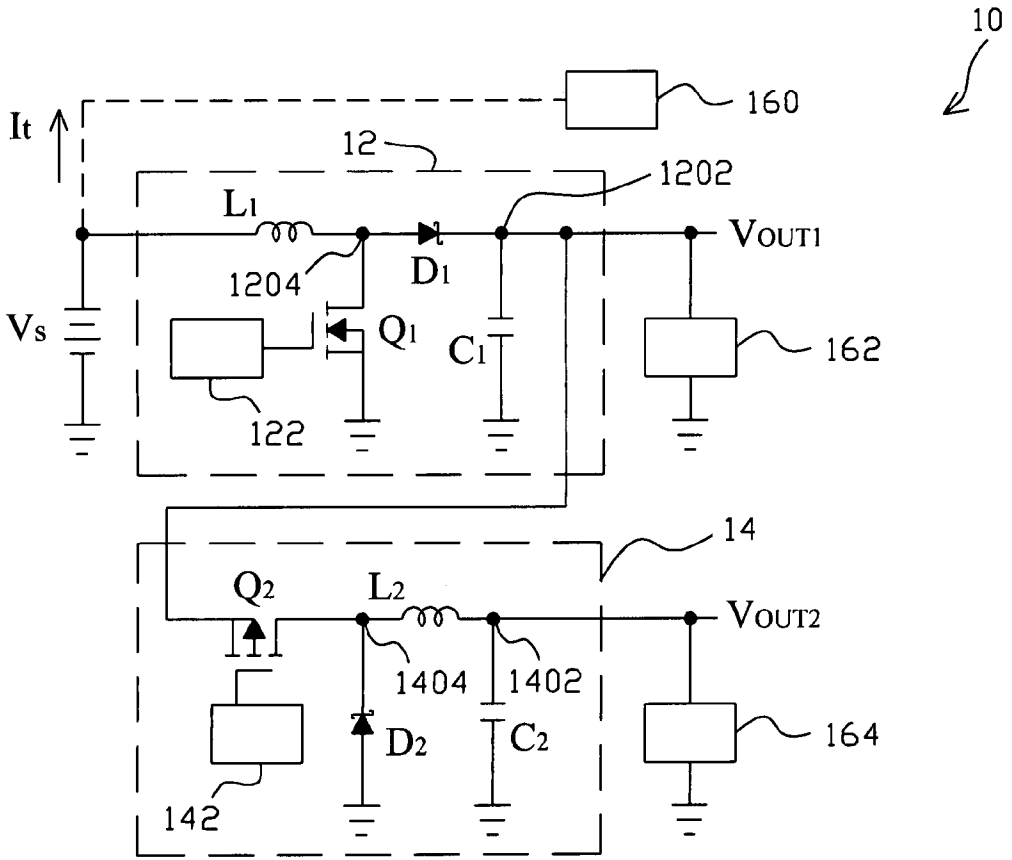
Fig. 1 (Prior Art)
FIG. 1 shows a conventional two-stage voltage converter.
Figure 2:
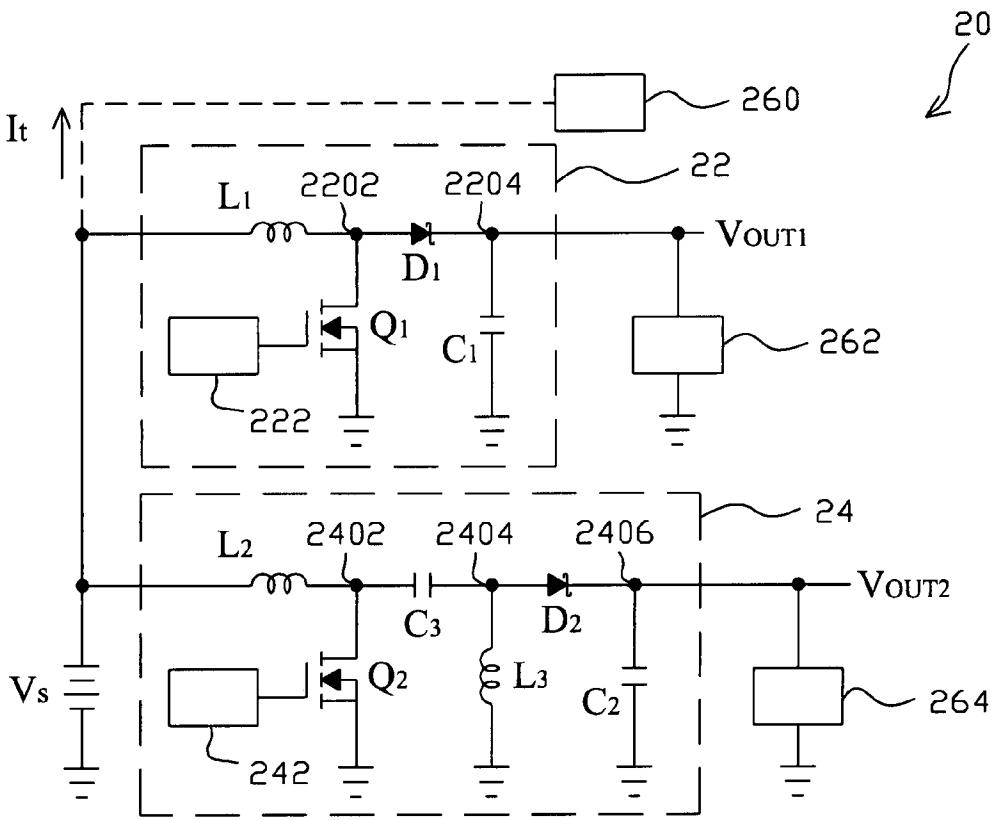
Fig. 2 (Prior Art)
FIG. 2 shows a conventional SEPIC converter.
Figure 3:
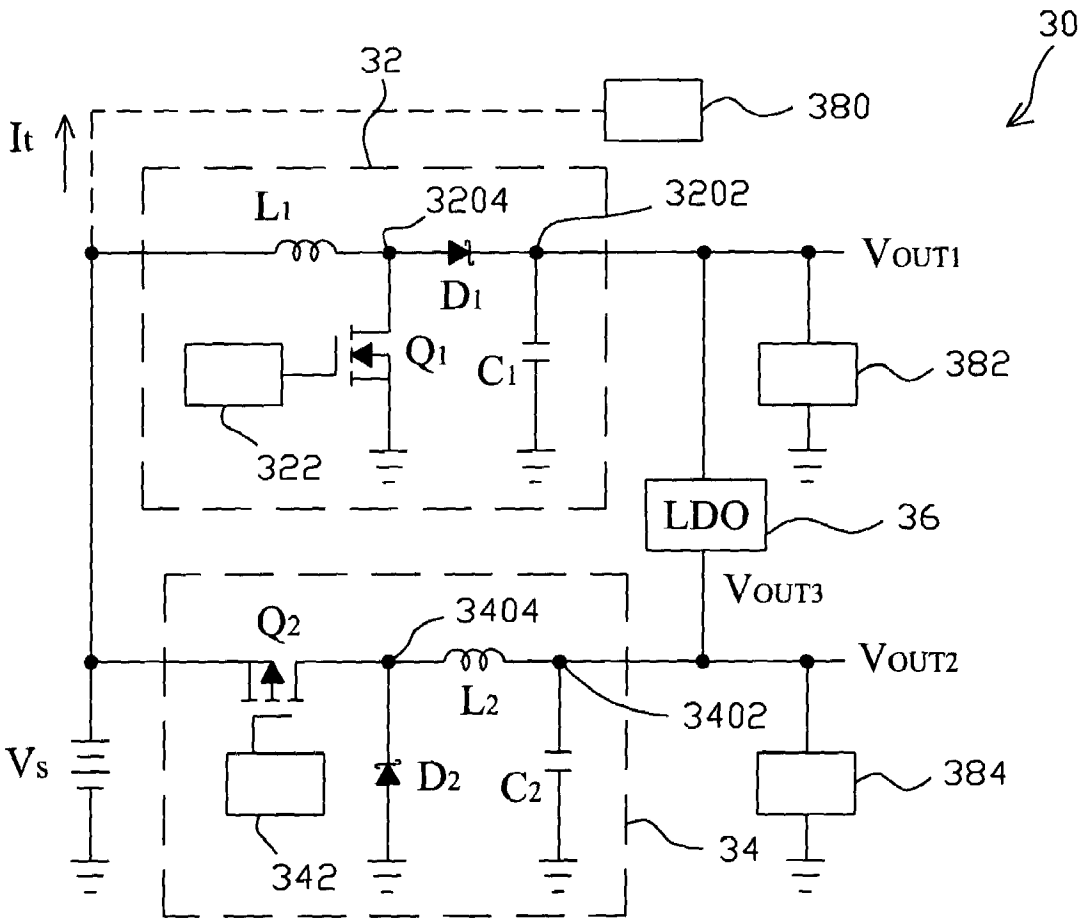
FIG. 3 shows an embodiment according to the present invention.

FIG. 3 shows an embodiment according to the present invention, in which linear mode and switch mode converters are combined together to improve the efficiency thereof. A voltage converter 30 comprises a boost converter 32 connected with a supply voltage $V_S$ to boost up the supply voltage $V_S$ to generate an output voltage $V_{OUT1}$, at its output 3202 to supply for a load 382 connected to the output 3202, a buck converter 34 connected with the supply voltage $V_S$ to buck down the supply voltage $V_S$ to generate another output voltage $V_{OUT2}$ at its output 3402 to supply for another load 384 connected to the output 3402, and an LDO regulator 36 connected between the outputs 3202 and 3402 to convert the output voltage $V_{OUT1}$ to yet another output voltage $V_{OUT3}$ at the output 3402 connected with the load 384 when the output voltage $V_{OUT2}$ is lower than a threshold. The boost converter 32 comprises an inductor $L_1$ connected between the supply voltage $V_S$ and a node 3204, a diode $D_1$ connected between the node 3204 and the output 3202, a capacitor $C_1$, connected between the output 3202 and ground, a transistor $Q_1$ connected between the node 3204 and ground, and a boost controller 322 to switch the transistor $Q_1$ for regulating the output voltage $V_{OUT1}$. On the other hand, the buck converter 34 comprises an inductor $L_2$ connected between the output 3402 and a node 3404, a diode $D_2$ connected between the node 3404 and ground, a capacitor $C_2$ connected between the output 3402 and ground, a transistor $Q_2$ connected between the supply voltage $V_S$ and the node 3404, and a buck controller 342 to switch the transistor $Q_2$ for regulating the output voltage $V_{OUT2}$.

In normal operation, the LDO regulator 36 does not work, and the voltage supplied to the load 384 is $V_{OUT2}$ provided by the buck converter 34. However, when the output voltage $V_{OUT2}$ is lower than the threshold because of power consumption of the battery or transient loading such as photoflash and motor, the LDO regulator 36 operates and provides the output voltage $V_{OUT3}$ supplied to the load 384. For typical applications, the supply voltage $V_S$ is in a range of from 1.8V to 3.3V, the output voltage $V_{OUT1}$ is about 3.3V, the output voltage $V_{OUT2}$ is about 1.8V, the output voltage $V_{OUT3}$ is about 1.75V, and the threshold is substantially equal to the output voltage $V_{OUT3}$, about 1.75V.

Figure 4:
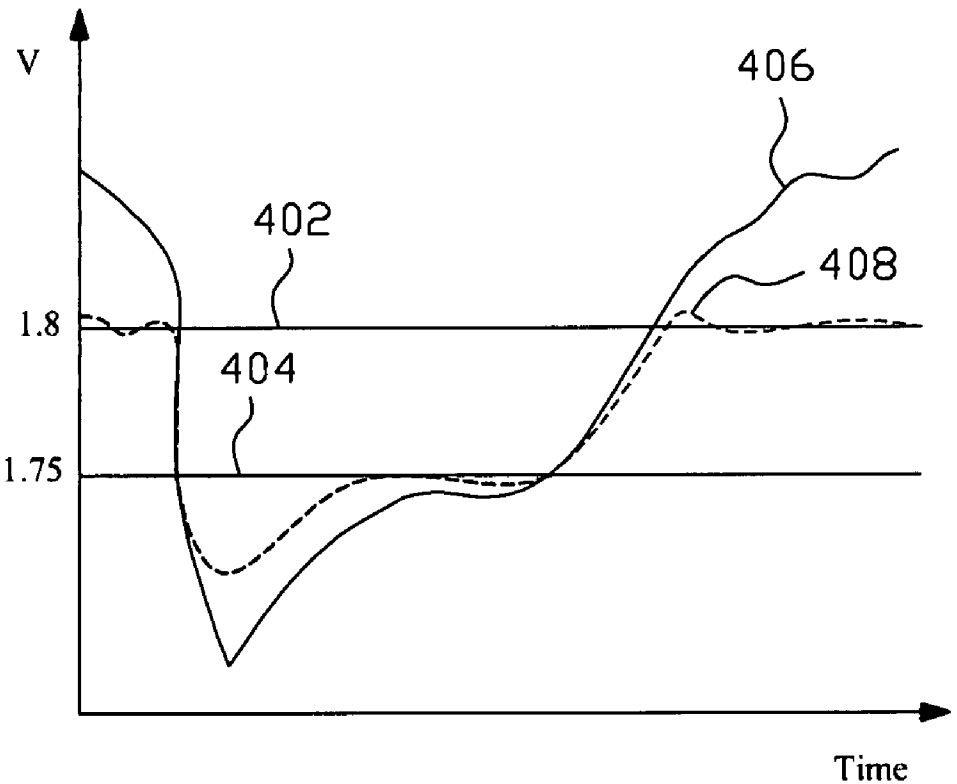
FIG. 4 shows the variation of the output voltage VOUT2 of the voltage converter 30 upon a transient loading.

FIG. 4 shows the variation of the output voltage $V_{OUT2}$ of the voltage converter 30 upon a transient loading such as photoflash and motor. In this diagram, the voltage level of 1.8V designated by curve 402 is the buck setting, and another voltage level of 1.75V designated by curve 404 is the LDO setting. Under steady state, the output voltage $V_{OUT2}$ of the buck converter 34 is maintained at 1.8V, which is larger than 1.75V of the LDO setting and thus, the LDO regulator 36 does not work. Upon a transient loading to induce a surge current $I_t$ flowing through the internal resistor of the battery, as shown by curve 406, the supply voltage $V_S$ drops down violently, resulting in 100% of buck converter duty and falling down of the output voltage $V_{OUT2}$ eventually, as shown by curve 408. Once the output voltage $V_{OUT2}$ under 1.75V of the LDO setting, the LDO regulator 36 is triggered to convert the output voltage $V_{OUT1}$ to the output voltage $V_{OUT3}$ at the output 3402 of the buck converter 34 and eventually, the LDO regulator 36 substitutes for the buck converter 34 to supply power for the load 384 to maintain the normal operation of the load 384. When the supply voltage $V_S$ is recovering such that the output voltage $V_{OUT2}$ of the buck converter 34 reaches 1.75V of the LDO setting, the LDO regulator 36 stops working, and the buck converter 34 takes the role back to supply power for the load 384. After the transient event, the battery voltage $V_S$ is recovered to its original level, and the output voltage $V_{OUT2}$ of the buck converter 34 is maintained at 1.8V again. Most of operational time the battery voltage $V_S$ is above 1.8V, and the power conversion is performed by the buck converter 34, instead of the LDO regulator 36. As a result, the average efficiency of the voltage converter 30 is improved because of the efficient buck converter 34, even though the LDO regulator 36 has poor efficiency.

Figure 5:
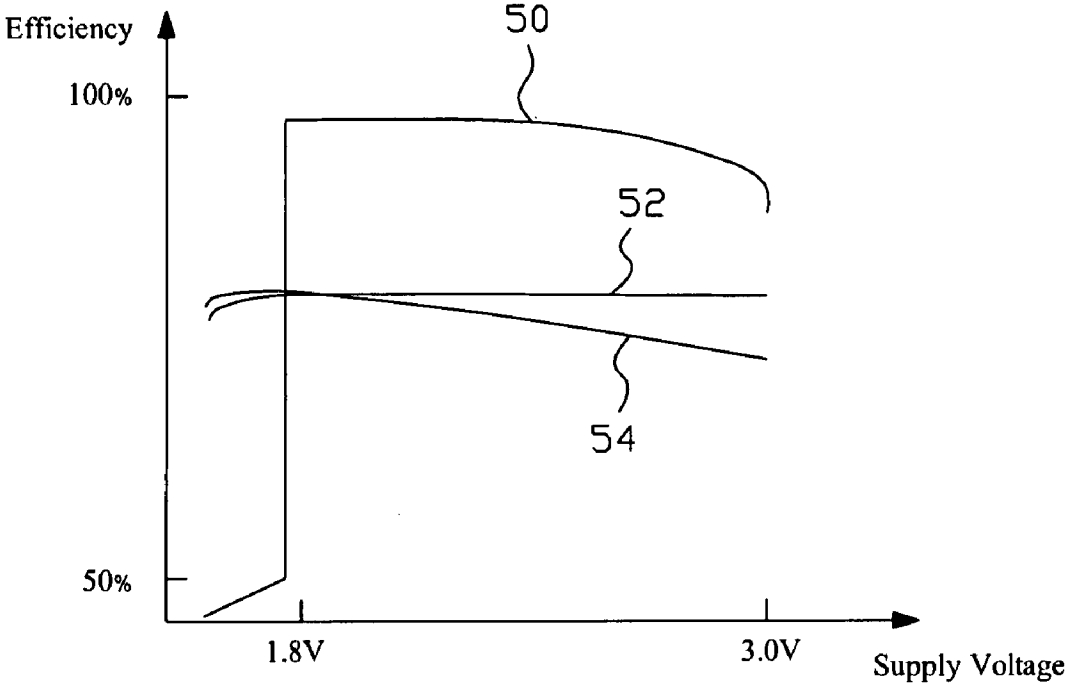
FIG. 5 shows the relations between power conversion efficiency and supply voltage for the voltage converter according to the present invention and the conventional voltage converters.

Another situation the battery voltage $V_S$ under desired range is occurred when the battery power is almost exhausted out. For comparison and more detailed illustration, FIG. 5 shows the relations between conversion efficiency and supply voltage for the voltage converter 30 according to the present invention and the conventional voltage converters 10 and 20. Curve 50 represents the efficiency to convert the supply voltage $V_S$ to the output voltage $V_{OUT2}$ by the voltage converter 30 according to the present invention, curves 52 and 54 represent for those by the conventional two-stage voltage converter 10 and SEPIC converter 20, respectively. When the supply voltage $V_S$ is within the range of from 1.8V to 3.0V, the conversion efficiency for the output voltage $V_{OUT2}$ according to the present invention is about within the range of from 90% to 97%, which is much larger than the range around 80% for the conventional two-stage voltage converter 10 and SEPIC converter 20. Due to the low efficient LDO regulator 36, the efficiency to generate the output voltage $V_{OUT3}$ according to the present invention drops rapidly to about 50% when the supply voltage $V_S$ is lower than 1.8V. However, the battery voltage $V_S$ under 1.8V is occurred when the battery power is almost exhausted out. Therefore, the total efficiency of the voltage converter 30 according to the present invention is still higher than the conventional voltage converters 10 and 20 about 5% to 10%.

Figure 6:
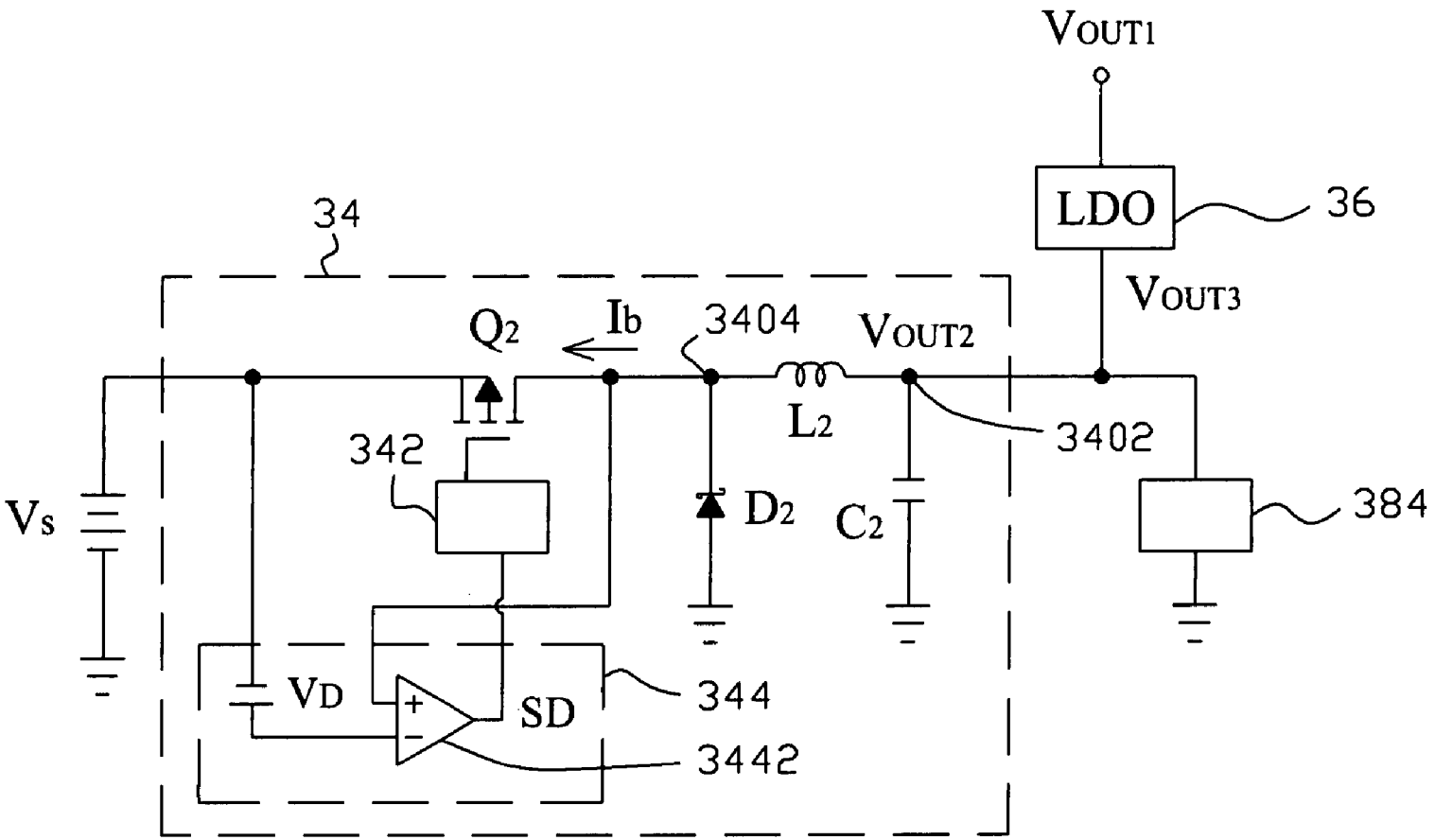
FIG. 6 shows an embodiment for the buck converter according to the present invention to prevent reverse current to flow toward to the battery.

Referring to FIG. 3, when the voltage on the node 3404 is higher than the supply voltage $V_s$, there will be a reverse current to flow toward to the battery. To prevent this reverse current $I_b$, FIG. 6 provides an embodiment for the buck converter 34 that further includes a shutdown circuit 344 to monitor the voltage drop across the transistor $Q_2$. For example, the shutdown circuit 344 includes a comparator 3442 that has a non-inverting input connected to the node 3404, and an inverting input coupled to the supply voltage $V_S$ with an offset $V_D$ of about 50mV inserted therebetween to compensate the cutoff voltage of the transistor $Q_2$. When the voltage on the node 3404 is higher than the supply voltage $V_S$ with a difference $V_D$, the shutdown circuit 344 generates a shutdown signal SD to turn off the transistor $Q_2$ by the buck controller 342, by which reverse current $I_b$ from the node 3404 through the transistor $Q_2$ to the battery is prevented.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. An efficiency improved voltage converter comprising:

a boost converter connected between a supply voltage and a first output for boosting up said supply voltage to generate a first output voltage at said first output;

a buck converter connected between said supply voltage and a second output for bucking down said supply voltage to generate a second output voltage at said second output; and an LDO voltage regulator connected in series between said first output and said second output for converting said first output voltage to a third output voltage at said second output when said second output voltage is lower than a threshold value.

2. The voltage converter according to claim 1, further comprising a shutdown circuit connected to said buck converter for turning off said buck converter when said second output voltage is less than said supply voltage to prevent reverse current flowing therethrough.

3. The voltage converter according to claim 2, wherein said shutdown circuit comprises a comparator for comparing a first voltage related to said supply voltage with a second voltage.

* * * * *